United States Patent [19]

Seki

[11] 4,310,375

[45] Jan. 12, 1982

[54] LOWER CORRUGATING ROLL IN A SINGLE FACER

[75] Inventor: Yukuharu Seki, Takehare, Japan

[73] Assignee: Mitsubishi Jukogyo Kabushiki Kaisha, Tokyo, Japan

[21] Appl. No.: 81,470

[22] Filed: Oct. 3, 1979

[30] Foreign Application Priority Data

Oct. 5, 1978 [JP] Japan ..... 53-137080[U]
Oct. 6, 1978 [JP] Japan ..... 53-123361

[51] Int. Cl.[3] ..... B31F 1/10; B31F 1/26

[52] U.S. Cl. ..... 156/462; 29/110; 29/121.1; 29/121.5; 29/121.6; 156/470; 156/473; 425/369

[58] Field of Search ..... 156/462, 470–473, 156/356; 29/121.1, 121.5, 121.6, 110; 425/369

[56] References Cited

U.S. PATENT DOCUMENTS

| | | | |
|---|---|---|---|
| 1,264,506 | 4/1918 | Hahn | 156/473 |
| 3,132,985 | 5/1964 | Moore | 156/471 |
| 3,947,206 | 3/1976 | Deligt et al. | 425/369 |
| 4,177,102 | 12/1979 | Tokuno | 425/369 |

*Primary Examiner*—Paul J. Thibodeau

*Attorney, Agent, or Firm*—Bernard, Rothwell & Brown

[57] ABSTRACT

In a single facer including an upper corrugating roll, a lower corrugating roll and a pressure roll, the lower corrugating roll is provided with a plurality of spaced circumferential grooves on the outer peripheral surface extending at right angles to the flutes of the corrugating roll. A plurality of circumferentially spaced bores are drilled in the roll extending in an axial direction and communicating with the bottoms of the aforementioned circumferential grooves. Suction means is disposed at one end surface of the roll for communicating with the bores. The suction means is selectively placed in communication with only those bores which at the time are in an angular position where a corrugated web is to be held in contact with the roll. In one preferred embodiment pressurized gas is placed in communication with selected bores to provide gas therethrough during the period when these selected bores are in an angular position where the corrugated web is to be released from the roll. The roll is formed to provide a hollow central portion and hot fluid is supplied to this central portion. In another preferred embodiment slotted pipes are placed in the bores with the slots in communication with the circumferential grooves.

11 Claims, 12 Drawing Figures

LOWER CORRUGATING ROLL IN A SINGLE FACER

BACKGROUND OF THE INVENTION

1. Field of the Invention

The invention relates to corrugated paper making machinery and more particularly to the lower corrugating rolls of such machinery.

2. Description of the Prior Art

For convenience in describing the prior art, prior art structures have been illustrated in FIGS. 1-5. A finger plate type construction is shown in FIG. 1 and a suction type construction is shown in FIG. 2. The single-facer shown in both of these figures comprises an upper corrugating roll 10 fluted on its outer peripheral surface and a similarly fluted lower corrugating roll 12. A web 14 fed from an earlier stage of the corrugated paper making machinery over the upper corrugating roll 10 is corrugated at the meshing portion between the upper roll 10 and the lower roll 12.

After the web 14 has been corrugated at the meshing portions, paste is applied to the flute crests of the corrugated web, identified by the numeral 16, from a pasting roll 18. The corrugated web 16 is then bonded to a liner web 20, fed over a pressure roll 22, to form the single-faced corrugated board 24. The bonding is effected by pressure exerted between the pressure roll 22 and the lower corrugating roll 12, and the single-faced corrugated board 24 is then fed to a subsequent stage of the machinery.

In the finger plate type construction shown in FIG. 1, finger plates 26 are provided along the outer peripheral surface of the lower corrugating roll 12 to counteract a tendency of the corrugated web 16 to move away from the lower corrugating roll 12, as illustrated in FIG. 3, under the influence of centrifugal force and to counteract the tendency of internal stress generated in the corrugated web 16 to restore the paper to its original flat form. In the suction type construction shown in FIG. 2 a plurality of passages 27 are provided in the lower corrugating roll 12' extending between the hollow interior portion 28 of this roll and the exterior peripheral surface thereof. A suction force is applied through the interior portion 28 to the corrugated web 16 passing over the exterior of the roll 12' to maintain the corrugated web in engagement with the flutes of the roll and to counteract the aforementioned tendencies.

The finger plate construction shown in FIG. 1 has the disadvantage that it is necessary to provide a substantial number of such finger plates 26 at spaced intervals along the length of the roll in order to accomplish the aforementioned purposes. Paste cannot be applied to the crests of the corrugated web 16 at the points where these finger plates are disposed and as a result the mechanical strength of the formed corrugated board is reduced below that which could otherwise be achieved. Further, the finger plates 26 have a relatively short life and usually have to be replaced in less than one month. Moreover, adjustment of the gap clearance between the finger plates 26 and the lower corrugating roll 12 is very critical; if the clearance is too great the precision in corrugation is degraded, whereas if it is too small there is a risk of damaging the corrugated web 16.

This shortcoming of the finger plate type construction is not present in the suction type construction shown in FIG. 2. As shown in more detail in FIGS. 4 and 5 this type of structure includes a plurality of circumferential grooves 30 on the outer peripheral surface of the roll 12'. These grooves are connected with the hollow interior portion 28 of the roll through the plurality of passages 27 providing communication between the grooves 30 and the interior portion 28. Suction is applied through a passage 34 at one end of the hollow interior porton 28, and the resulting negative pressure is applied to the corrugated web 16 through the passages 27 and the grooves 30 to cause the corrugated web to be held against the exterior fluted surface of the corrugated roll 12'.

However, a roll of this type requires a great deal of machining time and expense because several hundred holes or passages 27 are required and the diameter of these passages is necessarily small because the width of the grooves is narrow. Further, the roll has a very high hardness and the wall thickness is substantial. Another problem is that these holes, each being of small diameter and including a long straight portion, are susceptible to being blocked frequently by dust, dregs of paste, paper powder, etc. When some of the passages become blocked in this manner the corrugated web is not held properly against the roll and there is a degradation of quality. To keep the holes clear and avoid this degradation of quality requires substantial maintenance.

In the effective bonding of the elements of corrugated paper board a large amount of heat is necessitated and normally this heat is conveniently applied by introducing steam to the interiors of the hollow rolls. However, in the type of construction shown in the illustrated prior art steam cannot be introduced into the lower corrugating roll because of the necessity to utilize a vacuum therein. To overcome this problem preheating rolls were provided before the upper corrugating roll 10 and the pressure roll 22 to supply the required heat. However, such heating is inefficient and not suitable for high speed operations. Moreover, since the lower corrugating roll is not heated and since it receives radiant heat from the upper corrugating roll 10 and the pressure roll 22, the lower corrugating roll may become deformed and thus reduce product quality. Further, since the temperature of the lower corrugating roll is low, and the passages 27 are of small diameter and substantial length, there is a greater risk of blocking the passages 27 by paste sputtered from the pasting roll onto the lower corrugating roll where the paper web is not present, increasing the required maintenance.

Another prior art structure, not illustrated, does provide an arrangement where both heat and vacuum may be supplied through the hollow interior of the lower corrugating roll but this structure results in greater complexity of construction. Moreover, it does not provide as effective a force as the structure of the present invention in retaining the corrugated web in engagement with the lower corrugating roll for an appropriate interval and it does not include the provision of the present invention for insuring effective separation of the corrugated web from the corrugating roll at the appropriate time.

By the present invention these deficiencies of the prior art structures are overcome and a lower corrugating roll is provided in which machining is relatively easy, the blocking of the suction holes is eliminated, maintenance is reduced and better quality of corrugated paper board is insured. Further, the present invention provides both heat and suction in a relatively simple construction. Finally, it provides ejection means for promptly removing any paste or other materials which may find their way into the passages, thereby insuring continuous effectiveness of these passages.

SUMMARY OF THE INVENTION

In carrying out the invention, in one form thereof, there is provided a hollow lower corrugating roll in a single-facer which includes a plurality of spaced circumferential grooves on the outer peripheral fluted surface of the roll at right angles to the flutes. A plurality of circumferentially spaced bores are provided extending axially substantially the full length of the roll between the hollow interior thereof and the fluted surface thereof. These bores communicate with the bottoms of the aforementioned circumferential grooves. The bores extend through one end surface of the roll and suction means are disposed at this end surface to communicate with the bores to provide suction force at the surface of the roll. The roll is constructed so that hot fluid may be supplied to the hollow interior. The suction means are placed in communication with the appropriate bores so that the corrugated web is held in engagement with the surface of the lower corrugating roll during the appropriate interval, that is the angular interval extending from the point of contact with the upper roll to the point of contact with the pressure roll in the direction of rotation of the lower corrugating roll. Further, ejection means are provided in communication with appropriate bores during another interval, that is the angular interval between the point of contact between the lower corrugating roll and the pressure roll and the point of contact between the lower corrugating roll and the upper corrugating roll, again in the direction of rotation of the lower corrugating roll.

DESCRIPTION OF THE PREFERRED EMBODIMENTS

Figure 6:
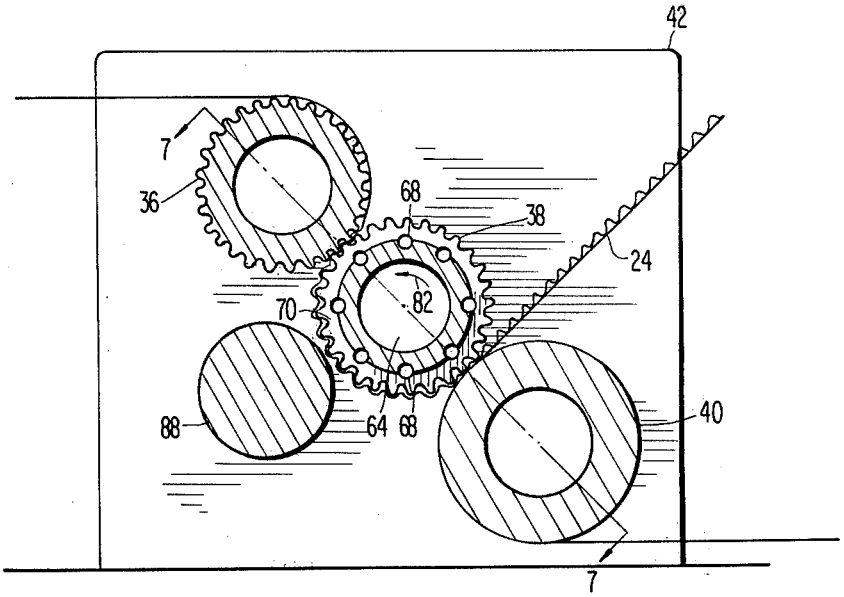
FIG. 6 is a transverse sectional view showing corrugating and bonding portions of a single-facer constructed in accordance with a first preferred embodiment of the present invention.
Figure 7:
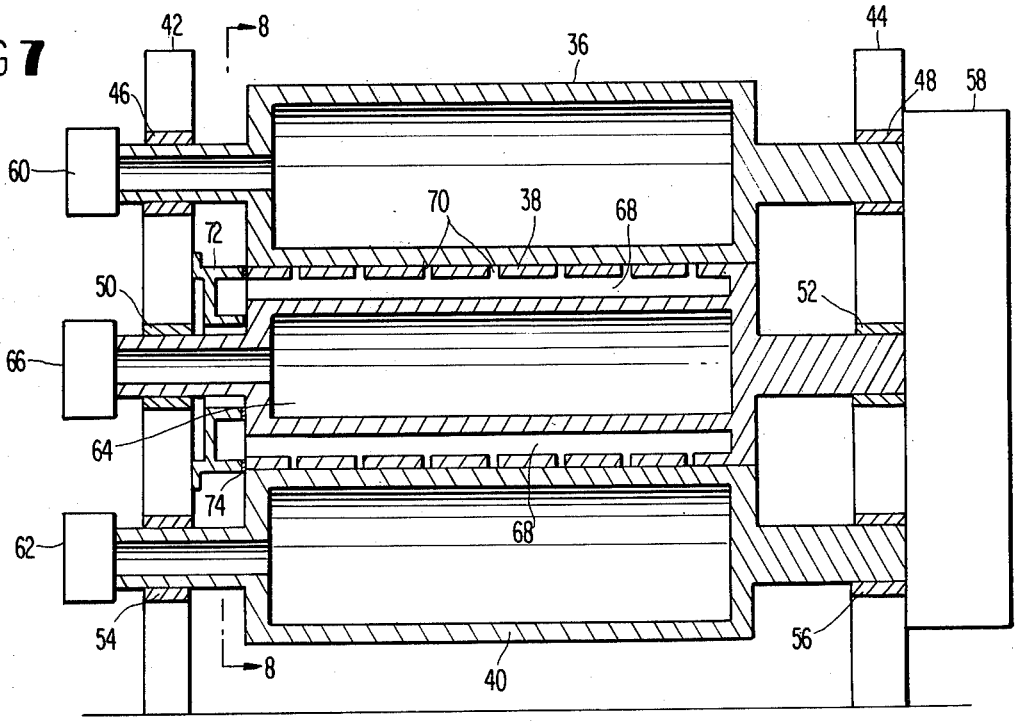
FIG. 7 is a longitudinal sectional view taken along the line 7—7 in FIG. 6.
Figure 8:
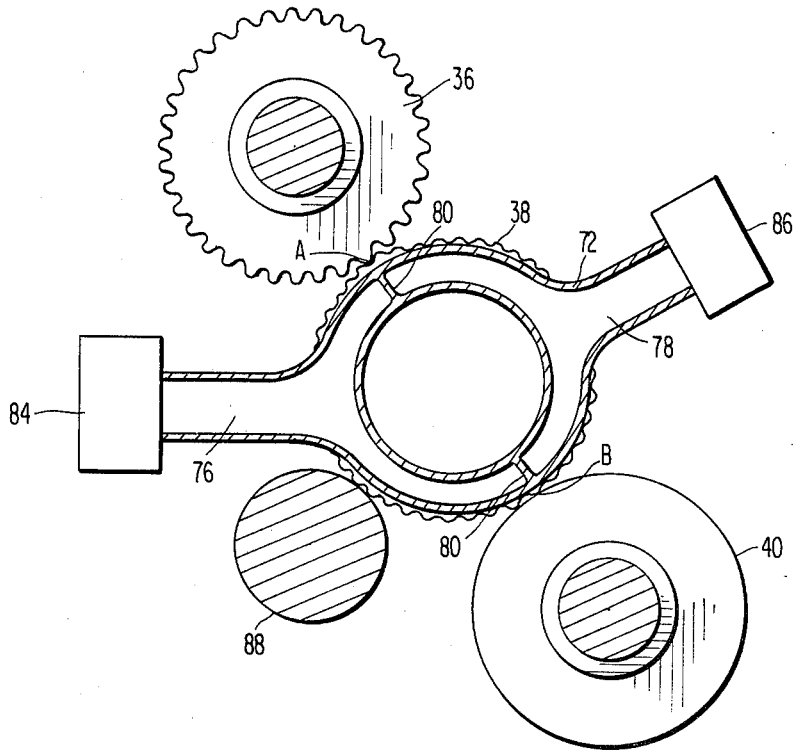
FIG. 8 is a transverse sectional view taken along the line 8—8 in FIG. 7.
Figure 9:
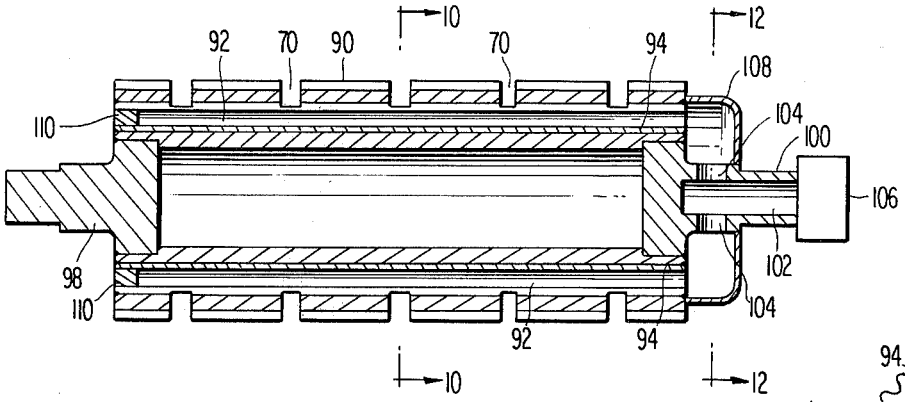
FIG. 9 is a longitudinal sectional view of a lower corrugating roll in a single-facer constructed in accordance with a second preferred embodiment of the present invention.
Figure 10:
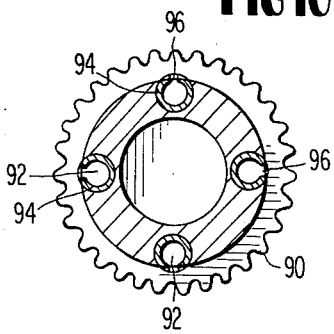
FIG. 10 is a sectional view taken along the line 10—10 in FIG. 9.

Referring to FIGS. 6–8, which illustrate one preferred embodiment of this invention, there are shown an upper corrugating roll 36 fluted on its outer peripheral surface, a lower corrugating roll 38 similarly fluted on its outer peripheral surface, and a pressure roll 40 which has a smooth peripheral surface. These rolls are rotatably supported at their opposite ends from frames 42 and 44 by means of bearings 46 and 48, 50 and 52, and 54 and 56 respectively. A mechanism for driving the aforementioned rolls is indicated generally at 58, but a detailed description thereof is not included because it may be made of conventional construction and is not directly related to the present invention. The upper corrugating roll 36 and the pressure roll 40 are of hollow construction and steam is fed to the hollow interior from steam supplies 60 and 62 disposed at one end of these rolls, so that these rolls can operate as high temperature rolls.

The lower corrugating roll 38 is also formed with a hollow central portion indicated at 64 to which steam is supplied from a steam supply 66 disposed at one end of the roll 38 so that this roll also can operate as a high temperature roll. In order to provide for the supplying of a suction force to the outer surface of the roll 38 a plurality of axially extending bores 68 are provided in this roll between the hollow interior and the fluted exterior of the roll. These bores 68 extend substantially the full length of the roll 38, being open at one end of the roll. A plurality of encircling grooves 70 are disposed in spaced relation at appropriate intervals on the outer peripheral surface of the roll. Each of the grooves extends in a circumferential direction transversely of the flutes on the outer peripheral surface of the roll; in the form shown the grooves are at right angles to the flutes. The bottom of each of the grooves 70 extends into the bores 68 and in communication therewith. In order to provide suction through the bores 68 and the grooves 70 to the exterior surface of the roll 38 and to provide for the supply of ejecting gas through these passages a suction/ejection box 72 is provided at the end of the roll which includes the open ends of the bores 68. This suction/ejection box 72 is movably supported from the frame 42. At the point where the box 72 engages the rotatable roll 38 there is provided a seal member 74.

As best illustrated in FIG. 8 the suction/ejection box 72 is constructed so that the suction portion 76 thereof is placed in communication with the bores 68 at a predetermined angular position of these bores, and the ejection portion 78 thereof is placed in communication with the bores 68 at another predetermined angular position of these bores. The interior of the suction/ejection box is divided into suction and ejection portions 76 and 78 respectively by partitions 80, so that communication is provided between the suction means and the bores only when the corrugated web is to be held in contact with the peripheral surface of the roll 38 and communication is provided between the ejection means and the bores only when the corrugated web is not to be held in contact with the peripheral surface of the roll 38. As shown in FIG. 8 the suction portion 76 is positioned relative to the roll 38 so as to be in line with bores communicating with the exterior surface of the roll 38 in the region, extending in the direction of rotation of the roll 38 indicated by the arrow 82, from a meshing point A between the upper corrugating roll 36 and the lower corrugating roll 38 to a contact point B between the lower roll 38 and the pressure roll 40. Similarly, the ejection portion 78 is positioned in alignment with bores 68 which communicate with the remaining peripheral surface of the roll 38; that is with the region, in the direction of rotation of the roll 38, between the point B and the meshing point A. The suction portion 76 is connected to a suction means 84 and the ejection portion 78 is connected to ejection means, such as a source of gas under pressure, indicated at 86. Since the suction/ejection box 72 is movably supported it may be adjusted if necessary to position the partitions 80 in proper relationship to the points A and B.

Figure 1:
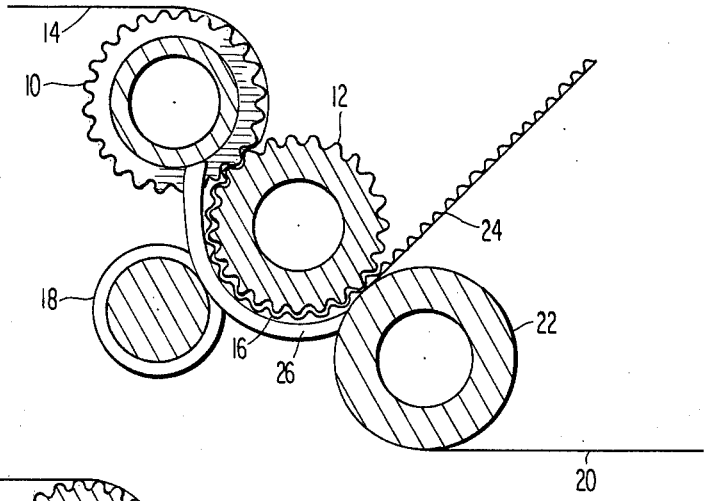
FIG 1 PRIOR ART
FIG. 1 is a cross sectional view of a portion of one prior art type of single-facer.
Figure 2:
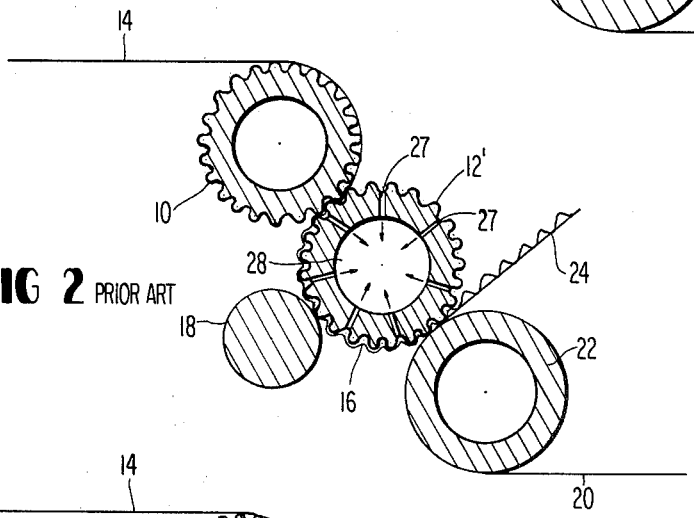
FIG 2 PRIOR ART
FIG. 2 is a similar view of another prior art type single-facer.
Figure 3:
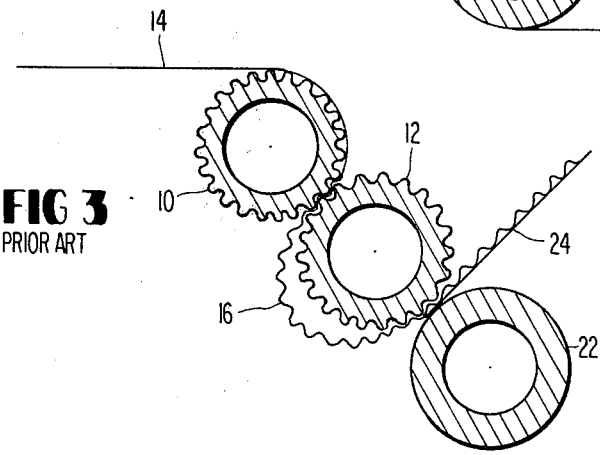
FIG 3 PRIOR ART
FIG. 3 is a sectional view of a portion of the single-facer structure illustrating a problem encountered.
Figure 4:
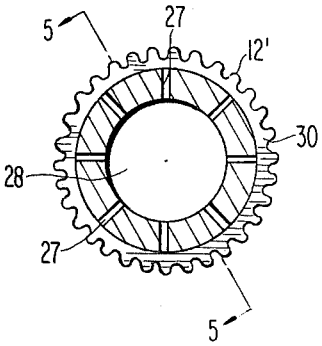
FIG 4 PRIOR ART
FIG. 4 is a sectional view in more detail of the lower corrugating roll illustrated in FIG. 2.
Figure 5:
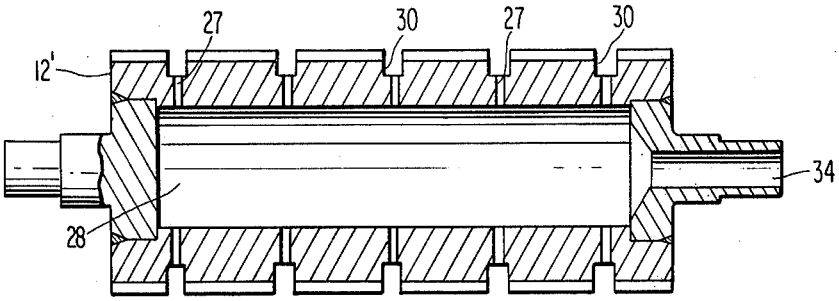
FIG 5 PRIOR ART
FIG. 5 is a longitudinal sectional view of the lower corrugating roll taken along the line 5—5 in FIG. 4.

Accordingly, air is sucked through the portion 76 of the suction/ejection box 72, the bores 68 aligned therewith and the portion of the grooves 70 communicating with these bores in the region of the outer peripheral surface of the roll 38 extending, in the direction of rotation of the roll 38, from the point A to the point B, that is on the side of the pasting roll 88. Therefore, the corrugated web 16 is held in the flutes of the roll 38 during the time the web is travelling from point A to point B and during the time that the paste is applied thereto and up to the point where the bonding with the liner 20 has been accomplished by the pressure roll 40. As a result, the paste can be properly applied to the crests of the corrugations and the tendency of the corrugated web to leave the lower corrugating roll and also the tendency of the corrugated web to return toward its original flat surface are avoided. Thus, the problem illustrated in FIG. 3 is avoided.

Similarly, when gas under pressure is supplied from the source 86, this gas is supplied to the aligned bores 68 and the portion of the circumferential grooves 70 communicating with these bores in the region of the outer peripheral surface of the roll 38 extending, in the direction of rotation of the roll 38, from the point B to the point A, that is on the side opposite the pasting roll 88. Thus, the gas under pressure is supplied to the area where the corrugated web, now bonded to the liner to form the single face material, is not in contact with the roller 38. While it is contemplated that air would normally supply the ejection force, steam or other gas could be employed if desired.

The operation of the embodiment just described is as follows. A web 14 fed from the preceding stage of the machinery over the upper corrugating roll 36 is corrugated by meshing of the flutes of the upper corrugating roll 36 with those of the lower corrugating roll 38. Paste is applied to the crests of the corrugations by means of the pasting roll 88 while the corrugated web 14 is held in engagement with the outer peripheral surface of the lower corrugating roll 38 by suction supplied from the suction means 84 through the suction portion 76 of the suction/ejection box 72. This force is strong enough to overcome the centrifugal force exerted upon the moving corrugated web 14 as well as the internal stress in the web generated during the corrugating process. The web 14 is bonded to the liner 20 as it moves between the lower corrugating roll 38 and the pressure roll 40, being thus formed into a single-faced board 24 which is then fed to the succeeding stage of the machinery. During this operation the lower corrugating roll 38 is held at a high temperature by introducing steam into its hollow interior 64. Sufficient heat for the corrugating and bonding operations can thus be supplied without the necessity of employing preheating rolls. While the paste sputtered from the pasting roll 88 adheres on the surface portion of the roll 38 where a corrugated web 14 is not present, it becomes powder because the roll 38 is held at a high temperature and this powder will tend to leave the roll 38. Even should any of the circumferential grooves 70 become temporarily blocked by paste, powder, etc. this blocking material is ejected by the gas under pressure supplied from the source 86.

The lower corrugating roll 38 in this embodiment can be machined in a very simple manner, because in this roll 38 it is necessary only to drill a plurality of bores 68 from one end surface of the roll in parallel to the axis of the roll, these bores communicating with the bottoms of the plurality of circumferential grooves 70 encircling the outer peripheral surface of the roll. This provides passages for supplying a suction force at each of these grooves extending over the entire semicircular portion of the grooves subjected to the suction and thus provides a greater extent of surface of the corrugated web 14 which is drawn against the peripheral surface of the roll than in the case where only a plurality of individual holes or passages are provided. Further, the plurality of circumferential grooves encircling the roll are not as susceptible to being blocked by paste, powder, etc. as a plurality of individual small passages.

Futher, in accordance with the present invention, an ejection means disposed at one end of the roll is arranged to be selectively communicated with a plurality of the bores 68 at a particular position of the roll to eject a gas through the passages. Therefore, even if paste should be sputtered during the pasting operation on a surface portion of the roll where the corrugated web is not present and adhere to that surface, the paste would not only tend to dry to powder because of the high temperature condition of the roll and leave the roll, but even if this should not occur the dried paste or other foreign matter would be ejected from the passages by the gas under pressure supplied from the source 86.

Finally, in accordance with this invention, suction is not effected through the hollow central interior of the roll but rather through passages extending longitudinally through the body of the roll itself so that the central interior portion is available for supplying of hot fluid to heat the roll.

A second preferred embodiment of the present invention is illustrated in FIGS. 9 to 12. Referring to these figures there is shown a lower corrugating roll 90 which has plurality of circumferential grooves 70 formed on the outer peripheral surface in the same manner as in the structure shown in the embodiment previously described. Circumferentially spaced bores 92 are drilled in the roll in an axial direction extending throughout the entire length of the roll. These bores, as in the embodiment previously described, are positioned to communicate with the bottoms of the circumferential grooves 70. Pipes 94 are inserted in each of these bores. These pipes extend over almost the entire length of the roll and one end or both ends of each of the pipes 94 are fixedly secured to the roll in any suitable manner. The pipes 94 are formed with slots or notches 96 to provide communication with the grooves 70. Such slots must be provided in the pipes at least in the region of each of the intersecting grooves 70, but, for ease of manufacture and assembly, each pipe may be formed with a continuous slot extending along substantially its entire length. In the assembled position of the pipes these slots are positioned radially outward so as to communicate with the bottom of the circumferential grooves 70.

Figure 11:
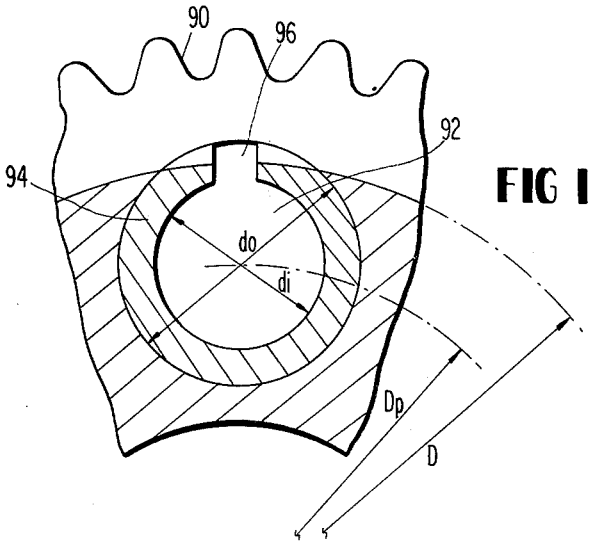
FIG. 11 is an enlarged view of a portion of the structure illustrated in FIG. 10.
Figure 12:
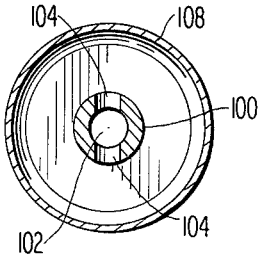
FIG. 12 is a sectional view taken along the line 12—12 in FIG. 9.

Details of the structure of the pipes 94 are shown in FIG. 11. As there illustrated the diameter of a circle formed by the cross section of the bottom surface of each groove 70 is indicated by D. The diameter of a pitch circle of the axes of the bores 92, and of the pipes 94, is indicated by $D_p$. The outer diameter of the pipe 94 is indicated by $d_o$ and the inner diameter of the pipe is indicated by $d_i$. These parameters are selected so as to provide the relation of $D_p+D_i<D<D_p+d_o$. Bosses 98 and 100 are provided at the ends of the roll, these bosses being suitable for reception in bearings. At the central portion of the boss 100 there is provided a suction bore 102. Radially extending bores 104 are provided in the boss 100 to provide communication between the suction bore 102 and the exterior of the boss 100. At the outer end of the bore 102 there is provided a suitable suction means 106. A seal plate 108 is mounted on the boss and extends into engagement with the end of the roll 90 radially beyond the bores 92 and pipes 94 so as to cover the radial passages 104 and the adjacent ends of the bores 92 and pipes 94. The opposite ends of the bores 92 and pipes 94 are sealed by plugs 110.

In this second embodiment the suction force provided from the suction means 106 is transmitted to the corrugated web 14 positioned on the outer peripheral surface of the roll 90 through the suction bore 102, the radial passages 104, the pipes 94, the slots 96 in these pipes and the circumferential grooves 70 to cause the corrugated web 14 to adhere tightly to the roll 38.

In this embodiment, as in the case of the first-described embodiment, since the bores 92 and the pipes 94 for transmitting the suction force are employed in communication with circumferential grooves extending around the entire exterior surface of the roll 90, the number of these bores and pipes can be smaller than would be necessary should they merely communicate with passages drilled radially to the exterior of the roll. With particular respect to this second embodiment, since the pipes 94 are inserted into the bores 92, even should there be some unevenness or other slight machining error along the lengthwise direction of the bores, the suction force would not vary along the length of the roll, because the pipes and the slots therein will provide proper communication with the circumferential grooves 70. Thus even if the depth of the circumferential grooves should vary or the radial position of the bores 92 should vary along the length of the roll, the intersection of the slots in the pipes 94 with the circumferential grooves would still provide an opening of the same size at each such junction. Therefore, the machining of the lower corrugating roll is simplified, the machining time is shortened and the cost is reduced. Furthermore, since the size of the bores 92 and the pipes 94 is not limited by the depth of the grooves 70, the diameters of these bores and pipes can be selected larger than would otherwise be possible. Therefore, the possibility of these bores and pipes being blocked by the accumulation of dirt, such as paste dregs, paper powder, etc., resulting in a reduction of the suction force, can be substantially reduced or eliminated. Maintenance of the machinery is thereby also reduced.

Although the second preferred embodiment illustrated in FIGS. 9–12 has been described in connection with a structure in which the lower corrugating roll is provided with only a suction device, it will be apparent that this roll could be provided with both a suction device and an ejection device of a construction similar to that described in connection with the first preferred embodiment illustrated in FIGS. 6–8.

Since many changes and modifications could be made in the above-described constructions without departing from the spirit of the present invention, it is intended that all matter described in the specification and illustrated in the accompanying drawings shall be interpreted as illustrative and not in a limiting sense. For example, while the invention has been described in connection with apparatus in which the rolls are positioned so that there is an upper corrugating roll and a lower corrugating roll, it is equally applicable to apparatus in which the rolls are arranged along a horizontal line. Also, while the circumferential grooves have been described as extending continuously around the corrugating roll, it will be apparent that the invention would also operate satisfactorily if the groove were discontinuous, that is, interrupted at intervals, so long as suction passages to the interior of the roll are not blocked. It is intended therefore to cover, by the appended claims, all modifications coming within the spirit and scope of this invention.

What is claimed is:

1. In a single facer including an upper corrugating roll, a lower corrugating roll having a hollow interior and having flutes extending longitudinally along its outer peripheral surface, and a pressure roll, the improvement comprising:

(a) a plurality of grooves in the outer peripheral surface of the lower corrugating roll, said grooves being spaced at intervals along said lower corrugating roll and encircling said lower corrugating roll transversely of said flutes;

(b) a plurality of circumferentially spaced bores in said lower corrugating roll between said hollow interior and said peripheral surface, said bores extending through one end surface of said lower corrugating roll and extending substantially the full length of said lower corrugating roll, said bores intersecting said grooves to provide communication with said peripheral surface of said lower corrugating roll; and (c) suction means disposed adjacent said one end surface and communicating with said bores to provide suction at said peripheral surface of said lower corrugating roll to maintain a corrugated web in contact with said peripheral surface.

2. The improvement recited in claim 1 and further including means providing communication between said suction means and said bores only when said bores are in a rotational position where said corrugated web is to be held in contact with said peripheral surface.

3. The improvement recited in claim 2 and further including:

(a) ejection means disposed adjacent said one end surface to provide gas under pressure at said peripheral surface of said lower corrugating roll; and (b) means providing communication between said ejection means and said bores to provide gas under pressure to said peripheral surface only when said bores are in a rotational position where the corrugated web is not to be held in contact with said peripheral surface.

4. The improvement recited in claim 1 and further including means providing communication between said suction means and said bores only when said bores are positioned in the angular interval extending from the point of contact between said upper corrugating roll and said lower corrugating roll to the point of contact between said lower corrugating roll and said pressure roll in the direction of rotation of said lower corrugating roll.

5. The improvement recited in claim 4 and further including:

(a) ejection means disposed adjacent said one end surface to provide gas under pressure at said peripheral surface of said lower corrugating roll; and (b) means providing communication between said ejection means and said bores to provide gas under pressure to said peripheral surface only when said bores are positioned in the angular interval extending from the point of contact between said pressure roll and said lower corrugating roll to the point of contact between said lower corrugating roll and said upper corrugating roll in the direction of rotation of said lower corrugating roll.

6. The improvement recited in claim 1 and further including means for supplying hot fluid to said hollow interior.

7. The improvement recited in claim 1 and further including:

(a) a plurality of pipes, one of said pipes being disposed in each of said bores; and (b) each of said pipes being slotted at its radially outward surface to provide communication with said grooves.

8. The improvement recited in claim 7 and further including means providing communication between said suction means and said pipes only when said pipes are positioned in the angular interval extending from the point of contact between said upper corrugating roll and said lower corrugating roll to the point of contact between said lower corrugating roll and said pressure roll in the direction of rotation of said lower corrugating roll.

9. The improvement recited in claim 8 and further including:

(a) ejection means disposed adjacent said one end surface to provide gas under pressure at the peripheral surface of said lower corrugating roll; and (b) means providing communication between said ejection means and said pipes to provide gas under pressure to said peripheral surface only when said pipes are positioned in the angular interval extending from the point of contact between said pressure roll and said lower corrugating roll to the point of contact between said lower corrugating roll and said upper corrugating roll in the direction of rotation of said lower corrugating roll.

10. The improvement recited in claim 7 wherein:

(a) said bores extend the full length of said lower corrugating roll;

(b) said pipes extend substantially the full length of said lower corrugating roll and are fixed to said lower corrugating roll; and further including:

(c) a plurality of plugs, each of said plugs being positioned in a corresponding one of said bores at the other end surface of said lower corrugating roll to close said bores at said other end surface.

11. In a single facer including an upper corrugating roll, a lower corrugating roll having a hollow interior and having flutes extending longitudinally along its outer peripheral surface, and a pressure roll, the improvement comprising:

(a) a plurality of grooves in the outer peripheral surface of the lower corrugating roll, said grooves being spaced at intervals along said lower corrugating roll and encircling said lower corrugating roll transversely of said flutes;

(b) a plurality of circumferentially spaced bores in said lower corrugating roll between said hollow interior and said peripheral surface, said bores extending through one end surface of said lower corrugating roll and extending substantially the full length of said lower corrugating roll, said bores intersecting said grooves to provide communication with said peripheral surface of said lower corrugating roll;

(c) a suction/ejection box disposed adjacent said one end surface, said suction/ejection box being partitioned to provide a suction portion and an ejection portion;

(d) said suction portion communicating with said bores only when said bores are in the angular interval extending from the point of contact between said upper corrugating roll and said lower corrugating roll to the point of contact between said lower corrugating roll and said pressure roll in the direction of rotation of said lower corrugating roll; and (e) said ejection portion communicating with said bores only when said bores are positioned in the angular interval extending from the point of contact between said pressure roll and said lower corrugating roll to the point of contact between said lower corrugating roll and said upper corrugating roll in the direction of rotation of said lower corrugating roll.

* * * * *